US006702936B2

(12) United States Patent
Rettger et al.

(10) Patent No.: US 6,702,936 B2
(45) Date of Patent: Mar. 9, 2004

(54) METHOD OF AND APPARATUS FOR UPGRADING AND GASIFYING HEAVY HYDROCARBON FEEDS

(75) Inventors: Philip Rettger, Walnut Creek, CA (US); Randall Goldstein, Moraga, CA (US); Jim Arnold, Calgary (CA)

(73) Assignee: Ormat Industries Ltd., Yavne (IL)

( * ) Notice: Subject to any disclaimer, the term of this patent is extended or adjusted under 35 U.S.C. 154(b) by 115 days.

(21) Appl. No.: 10/025,996

(22) Filed: Dec. 26, 2001

(65) Prior Publication Data

US 2003/0116470 A1 Jun. 26, 2003

(51) Int. Cl.[7] ..... C10G 67/16; C10G 69/14

(52) U.S. Cl. ..... 208/86; 208/85; 208/89; 196/14.52; 196/46; 196/100; 196/139; 202/153; 585/921

(58) Field of Search ..... 208/85, 86, 89; 196/14.52, 46, 100, 139; 202/153; 585/921

(56) References Cited

U.S. PATENT DOCUMENTS 1,876,270 A * 9/1932 Zorn ..... 208/108
5,958,365 A * 9/1999 Liu ..... 423/655
5,976,361 A * 11/1999 Hood et al. ..... 208/309

OTHER PUBLICATIONS

"Plant Processing of Natural Gas", Petroleum Extension Service, 1974, pp. 94–96.*

* cited by examiner

*Primary Examiner*—Walter D. Griffin
(74) *Attorney, Agent, or Firm*—Nath & Associates PLLC; Gary M. Nath; Jerald L. Meyer

(57) ABSTRACT

A novel apparatus for producing sweet synthetic crude from a heavy hydrocarbon feed comprising: an upgrader for receiving said heavy hydrocarbon feed and producing a distillate fraction including sour products, and high-carbon content by-products; a gasifier for receiving the high-carbon content by-products and producing synthetic fuel gas and sour by-products; a hydroprocessing unit for receiving the sour by-products and hydrogen gas, thereby producing gas and sweet crude; and a hydrogen recovery unit for receiving said synthetic fuel gas and producing further hydrogen gas and hydrogen-depleted synthetic fuel gas, said further hydrogen gas being supplied to said hydroprocessing unit.

28 Claims, 6 Drawing Sheets

METHOD OF AND APPARATUS FOR UPGRADING AND GASIFYING HEAVY HYDROCARBON FEEDS

BACKGROUND OF THE INVENTION

1. Field of the Invention

The present invention relates to a method of and apparatus for upgrading heavy hydrocarbon feeds. In particular, the method and apparatus include gasification of heavy high-carbon content by-products produced by the upgrading of the heavy hydrocarbon feeds.

2. Description of the Prior Art

Many types of heavy crude oils contain high concentrations of sulfur compounds, organo-metallic compounds and heavy, non-distillable fractions called asphaltenes which are insoluble in light paraffins such as normal pentane. Because most petroleum products used for fuel must have a low sulfur content to comply with environmental regulations and restrictions, the presence of sulfur compounds in the non-distillable fractions reduces their value to petroleum refiners and increases their cost to users of such fractions as fuel or raw material for producing other products. It is desirable to remove the non-distillable fractions, or asphaltenes, from the oil because not only do the non-distillable fractions contain high amounts of sulfur, the asphaltenes tend to solidify and foul subsequent processing equipment. Removal of the asphaltenes also tends to reduce the viscosity of the oil.

Solvent extraction of asphaltenes is used to process crude and produces deasphalted oil (DAO) which is subsequently further processed into more desirable products. The deasphalting process typically involves contacting a heavy oil with a solvent. The solvent is typically an alkane such as propane, butane and pentane. The solubility of the solvent in the heavy oil decreases as the temperature increases. A temperature is selected wherein substantially all the paraffinic hydrocarbons go into solution, but where a portion of the resins and asphaltenes precipitate. Because the solubility of the asphaltenes is low in the oil-solvent mixture, the asphaltenes will precipitate out and are further separated from the DAO.

In order to increase the saleability of these hydrocarbons, refiners must resort to various expedients for removing sulfur compounds. A conventional approach for removing sulfur compounds in distillable fractions of crude oil is catalytic hydrogenation in the presence of molecular hydrogen at moderate temperature and pressure. While this approach is cost effective in removing sulfur from distillable oils, problems arise when the feed includes metal-containing asphaltenes. Specifically, the presence of the metal-containing asphaltenes results in catalyst deactivation by reason of the coking tendency of the asphaltenes, and the accumulation of metals on the catalyst.

Many proposals thus have been made for dealing with non-distillable fractions of crude oil and other heavy hydrocarbons, include residual oil which contain sulfur and other metals. And while many are technically viable, they appear to have achieved little or no commercialization due in large part to the high cost of the technology involved. Usually such cost takes the form of increased catalyst contamination by the metals and/or carbon deposition resulting from the attempted conversion of the asphaltene fractions.

One way that refineries have attempted to receive more value from heavy hydrocarbons including asphaltenes has been to gasify them. U.S. Pat. No. 4,938,862 to Visser et al. discloses a process for thermal cracking residual hydrocarbon oils involving feeding the oil and a synthetic gas to a thermal cracker, separating the cracked products into various streams including a cracked residue stream, separating the cracked residue stream into an asphaltene-rich stream and an asphaltene-poor stream, then gasifying the asphaltene rich stream to produce syngas which is fed to the thermal cracker.

Likewise, U.S. Pat. No. 6,241,874 to Wallace et al. discloses extracting asphaltenes through with a solvent and gasifying the asphaltenes in the presence of oxygen. Heat from the gasification of the asphaltenes is used to help recover some of the solvent used in extracting the asphaltenes.

Further, U.S. Pat. No. 5,958,365 to Liu discloses processing heavy crude oil by distilling the same, solvent deasphalting the oil, and further processing the heavy hydrocarbons to produce hydrogen. The hydrogen is used to treat the deasphalted oil fraction and distillate hydrocarbon fractions obtained from the heavy crude oil.

However, there still remains a need for a cost-effective and commercially viable method of extracting more value out of asphaltenes produced in refineries.

BRIEF SUMMARY OF THE INVENTION

Applicants have unexpectedly developed an apparatus for producing sweet synthetic crude from a heavy hydrocarbon feed comprising:

a) an upgrader for receiving said heavy hydrocarbon feed and producing a distillate fraction including sour products, and high-carbon content by-products;

b) a gasifier for receiving said high-carbon content by-products and producing synthetic fuel gas and sour by-products;

c) a hydroprocessing unit for receiving said sour by-products and hydrogen gas, thereby producing gas and said sweet crude; and d) a hydrogen recovery unit for receiving said synthetic fuel gas and producing further hydrogen gas and hydrogen-depleted synthetic fuel gas, said further hydrogen gas being supplied to said hydroprocessing unit.

Applicants have further developed a method for producing sweet synthetic crude from a heavy hydrocarbon feed comprising:

a) upgrading said heavy hydrocarbon feed in an upgrader and thereby producing a distillate feed including sour products, and high-carbon content by-products;

b) gasifying in a gasifier said high-carbon content by-products and producing synthetic fuel gas and sour by-products;

c) hydroprocessing said sour products along with hydrogen gas, thereby producing gas and said sweet crude; and d) recovering hydrogen in a hydrogen recovery unit from said synthetic fuel gas and producing further hydrogen gas and hydrogen-depleted synthetic fuel gas, and supplying said further hydrogen gas to said hydroprocessing unit.

Furthermore, Applicants have unexpectedly developed an apparatus for producing sweet synthetic crude from a heavy hydrocarbon feed comprising:

a) an upgrader comprising:

I. a distillation column for receiving said heavy hydrocarbon feed and producing a distillate fraction, and a non-distilled fraction containing sulfur, asphaltene and metals;

II a solvent deasphalting unit for processing said non-distilled fraction and producing a deasphalted oil stream and an asphaltene stream, an outlet of said deasphalting unit containing said deasphalted oil being connected to an inlet of a thermal cracker and wherein said asphaltene stream comprises said high-carbon by-products;

III said thermal cracker thermally cracking said deasphalted oil and forming a thermally cracked stream;

b) a gasifier for gasifying said asphaltenes in the presence of air or oxygen and producing ash and a gas mixture:

c) a scrubber which receives said gas mixture and water and produces sour water and a clean sour gas mixture;

d) a first gas processor which receives said clean sour gas mixture and produces a sweet synthetic fuel gas, said first gas processor comprises:

I a solvent contactor which receives lean solvent from a solvent regenerator and said clean sour gas mixture and produces a sweet product and rich solvent;

II said solvent regenerator receiving said rich solvent and producing said lean solvent and acid gas;

III a sulfur recovery unit which receives said acid gas and produces sulfur and a sulfur-depleted gas which is vented to the atmosphere; and IV a liquid recovery unit which receives said sweet product and produces sweet gas, sour water and light liquid hydrocarbons;

e) a hydroprocessing unit for receiving said sour products and hydrogen gas, thereby producing gas and said sweet crude, said hydroprocessing unit comprising:

I a hydroprocessor which receives said distillate feed and hydrogen gas and produces a high-pressure hydroprocessed product;

II a first flash vessel which receives said high-pressure hydroprocessed product and produces high pressure sour gas and high pressure flashed product;

III a second flash vessel which receives said high pressure flashed product and produces low pressure sour gas and low pressure flashed product;

IV a stripper which receives said low pressure flashed product and steam and produces low pressure sour gas, sour water and sweet synthetic crude;

V a first solvent contactor in fluid communication with a first solvent regenerator and containing a clean solvent, said first solvent contactor receiving said high pressure high pressure sour gas from said first flash vessel and producing sweet recycle gas which is fed to said hydroprocessor and sour solvent, said first solvent regenerator receiving said sour solvent and producing said clean solvent which is fed to said first solvent contactor and hydrogen sulfide and ammonia; and VI a second solvent contactor in fluid communication with a second solvent regenerator and containing clean solvent, said second solvent contactor receiving said low pressure sour gas from said second flash vessel and from said stripper and producing fuel gas and sour solvent, said second solvent regenerator receiving said sour solvent and producing said clean solvent which is fed to said second solvent contactor.; and f) a hydrogen recovery unit for receiving said synthetic fuel gas and producing further hydrogen gas and hydrogen-depleted synthetic fuel gas, said further hydrogen gas being supplied to said hydroprocessing unit.

BRIEF DESCRIPTION OF THE DRAWINGS

Embodiments of the present inventive subject matter are described by way of example and with reference to the accompanying drawings wherein.

DETAILED DESCRIPTION OF THE EMBODIMENTS

The present inventive subject matter is drawn to a method of and apparatus for upgrading a heavy hydrocarbon feed in which heavy, high-carbon content by-products are gasified. As used herein, the term "sour" refers to product streams, gas streams and water streams that contain a high content of sulfur, hydrogen sulfide, and/or ammonia. The term "sweet" is used to denote product streams, gas streams and water streams that are substantially free from sulfur and hydrogen sulfide.

As used herein, the term "syngas" refers to a synthetic fuel gas. More particularly, "syngas" is a mixture of hydrogen, carbon monoxide, carbon dioxide, hydrogen sulfide, and small amounts of other compounds. For the purposes of this application, "syngas" and "synthetic fuel gas" are herein synonymous and used interchangeably.

The expression "line" as used herein refers to lines or conduits that connect different elements of the apparatus of the present inventive subject matter. "Line" includes, without limitation, conduits, streams, and the other items which may be used to transfer material from one element to another element.

"Gas processing unit" or "gas processor" refer to equipment arranged to remove hydrogen sulfide, ammonia and other impurities from a sour gas mixture. This is synonymous with a "gas sweetening unit" and the terms are used herein interchangeably.

Figure 1:
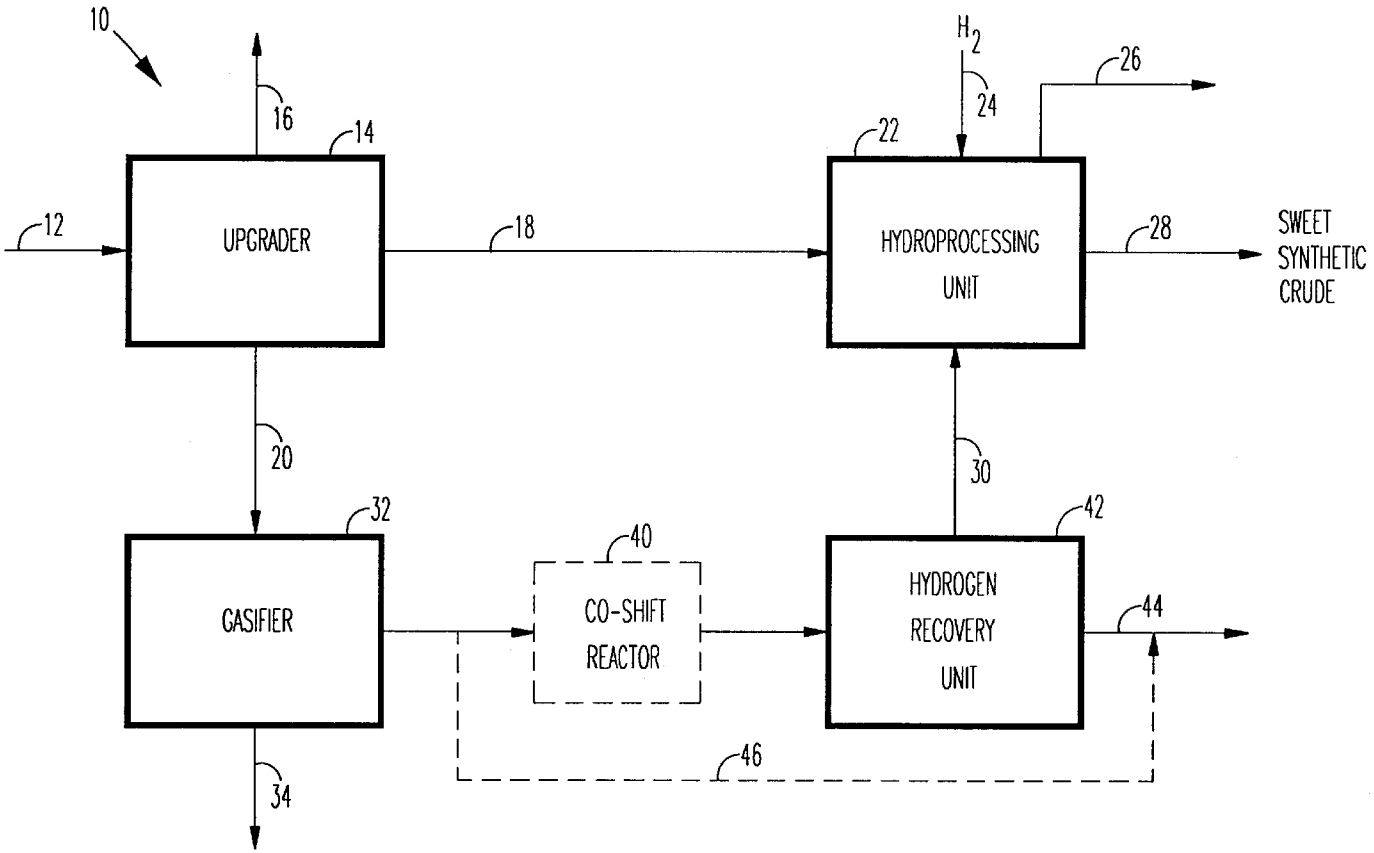
FIG. 1 is a block diagram of an embodiment of the present inventive subject matter wherein a heavy hydrocarbon feed is input into an upgrader.

Turning now to the figures, FIG. 1 is a block diagram of one embodiment of the present inventive subject matter. Numeral 10 designates an apparatus for producing a sweet synthetic crude product from a heavy hydrocarbon feed. Heavy hydrocarbon feed in line 12 is fed to upgrader 14. In upgrader 14, the heavy hydrocarbon feed is upgraded to produce gas in line 16, sour products in line 18 and high-carbon content by-products in line 20. Optionally, gas in line 16 may be fed to a gas processing unit as detailed below with respect to FIG. 5. Upgrader 14 may be constructed and arranged in accordance with FIG. 2, or upgrader 14 may be another other apparatus which takes a heavy hydrocarbon feed and produces a more commercially attractive range of products therefrom.

Sour products in line 18 are fed to hydroprocessing unit 22 along with hydrogen gas in line 24. Hydroprocessing unit 22 may be a hydrocracking unit or a hydrotreating unit, depending upon the temperatures and pressures at which the hydroprocessing unit is run. Running hydroprocessing unit 22 as a hydrocracking unit will result in a lower boiling point range for the sweet synthetic crude. The sour products and hydrogen gas react in hydroprocessing unit 22 producing sweet synthetic crude in line 28 and gas in line 26. Optionally, gas in line 26 may be fed to a gas processing unit as detailed below with respect to FIG. 5.

High-carbon content by-products from upgrader 14 are fed in line 20 to gasifier 32. The high-carbon content by-products are gasified in gasifier 32 in the presence of steam and oxygen (not shown). The amount of oxygen added to gasifier 32 is limited so that only partial oxidation of the hydrocarbons in the high-carbon content by-products occurs. The gasification process converts the high-carbon content by-products into syngas in line 36 and sour by-products in line 34. Some or all of the syngas in line 36 is then fed to hydrogen recovery unit 42, where hydrogen gas is removed from the syngas, thereby producing hydrogen-depleted syngas in line 44 and hydrogen gas in line 30. The hydrogen gas in line 30 is fed to hydroprocessing unit 22 for reaction with the sour products in line 18.

In an optional embodiment of the present inventive subject matter, some or all of the syngas in line 36 is optionally fed to carbon monoxide (CO) shift reactor 40 before being fed to hydrogen recovery unit 42. CO shift reactor 40 is a well-known piece of apparatus wherein the syngas in line 36 is partially reacted with steam (not shown) to form hydrogen gas and carbon dioxide. The hydrogen gas is then separated in hydrogen recovery unit 42 as is described above.

In a further optional embodiment of the present inventive subject matter, some or all of the syngas in line 36 may be fed directly to line 44 via line 46, thus by-passing CO shift reactor 40 and hydrogen recovery unit 42. The syngas in line 46 is then combined with the syngas in line 44.

Figure 2:
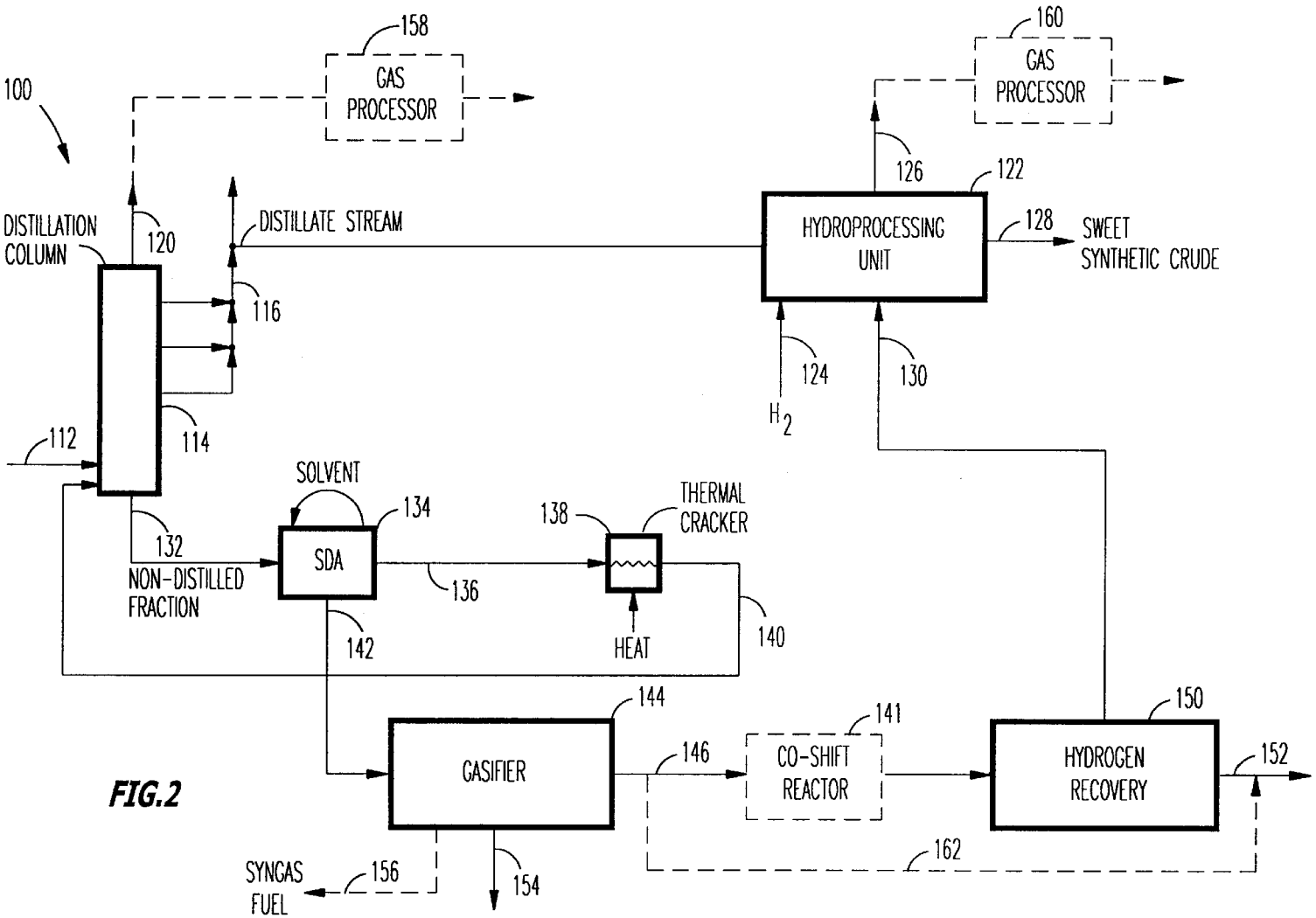
FIG. 2 is a block diagram of another embodiment of the present inventive subject matter.

Turning now to FIG. 2, numeral 100 represents another embodiment of an apparatus for producing sweet synthetic crude from a heavy hydrocarbon feed. Apparatus 100 comprises distillation column 114 which receives heavy hydrocarbon feed from line 112. Optionally, heavy hydrocarbon feed in line 112 may be heated (not shown) prior to being fed to distillation column 114. Distillation column 114 may be operated at near-atmospheric pressure or, by the use of two separate vessels, at an ultimate pressure that is subatmospheric. Fractionation takes place within distillation column 114 producing gas stream 120, one or more distillate streams shown as combined stream 116, which is substantially asphaltene-free and metal-free, and non-distilled fraction in line 132. In an optional embodiment, gas stream 120 may be fed to gas processing unit 158 which is detailed below with respect to FIG. 5.

All or a portion of the distillate fraction in line 116 is fed to hydroprocessing unit 122 along with hydrogen gas in line 124. Hydroprocessing unit 122 may be a hydrocracking unit or a hydrotreating unit, depending upon the temperatures and pressures at which the hydroprocessing unit is run. Running hydroprocessing unit 122 as a hydrocracking unit will result in a lower boiling point range for the sweet synthetic crude. The sour products and hydrogen gas react in hydroprocessing unit 122 producing sweet synthetic crude in line 128 and gas in line 126. Optionally, gas in line 126 may be fed to gas processing unit 160 as detailed below with respect to FIG. 5. Further still, it is an option of the present inventive subject matter that gas processing units 158 and 160 are the same apparatus, and gas in lines 120 and 126 will be simultaneously fed to the gas processing unit.

Non-distilled fraction in line 132 is applied to solvent deasphalting (SDA) unit 134 for processing the non-distilled fraction and producing deasphalted oil (DAO) in line 136 and high-carbon content by-products, or asphaltenes, in line 142. The high-carbon content by-products contain asphaltenes as well as other high-carbon content materials. SDA unit 134 is conventional in that it utilizes a recoverable light hydrocarbon including propane, butane, pentane, hexane and mixtures thereof for separating the non-distilled fraction into DAO stream 136 and high-carbon content by-product stream 142. The concentration of metals in DAO stream 136 produced by SDA unit 134 is substantially lower than the concentration of metals in non-distilled fraction applied to SDA unit 134. In addition, the concentration of metals in high-carbon content by-products stream 142 is substantially higher than the concentration of metals in DAO stream 136. DAO stream 136 is then fed to thermal cracker 138 where heat is applied. The heat applied to DAO stream in thermal cracker 138, and the DAO residence time in thermal cracker 138, serve to thermally crack the deasphalted oil. Thermal cracking involves the application of heat to break molecular bonds and crack heavy, high boiling point range, long-chain hydrocarbons into lighter fractions. The thermally cracked product in line 140 is fed back to distillation column 114, where the distillable parts of the cracked product in line 140 is separated and recovered as part of gas stream 120 and distillate stream 116.

In addition, thermal cracker 138 may contain catalyst to aid in thermal cracking the DAO. The catalyst can reside in thermal cracker 138, but is preferably in the form of an oil dispersible slurry carried by the relevant feed stream. The catalyst promotes cracking of DAO stream 136. The catalyst is preferably a metal selected from the group consisting of Groups IVB, VB, VIB, VIIB and VIII of the Periodic Table of Elements and mixtures thereof. The most preferred catalyst is molybdenum.

High-carbon content by-products which contain asphaltenes from SDA unit 134 are fed in line 142 to gasifier 144. The high-carbon content by-products are gasified in gasifier 144 in the presence of steam and oxygen (not shown). The amount of oxygen added to gasifier 144 is limited so that only partial oxidation of the hydrocarbons in the high-carbon content by-products occurs. The gasification process converts the high-carbon content by-products into syngas in line 146 and sour by-products in line 154. Some or all of the syngas in line 146 is then fed to hydrogen recovery unit 150, where hydrogen gas is removed from the syngas, thereby producing hydrogen-depleted syngas in line 152 and hydrogen gas in line 130. The hydrogen gas in line 130 is fed to hydroprocessing unit 122 for reaction with the distillate products in line 116. Optionally, syngas from gasifier 144 may be used as syngas fuel in line 156.

In an optional embodiment of the present inventive subject matter, some or all of the syngas in line 146 is fed to carbon monoxide (CO) shift reactor 141 before being fed to hydrogen recovery unit 150. CO shift reactor 141 is a well-known piece of apparatus wherein the syngas in line 146 is partially reacted with steam (not shown) to form hydrogen gas and carbon dioxide. The hydrogen gas is then separated in hydrogen recovery unit 150 as is described above.

In a further optional embodiment of the present inventive subject matter, some or all of the syngas in line 146 may be fed directly to line 152 via line 162, thus by-passing CO shift reactor 141 and hydrogen recovery unit 150. The syngas in line 162 is then combined with the syngas in line 152.

While it is shown in FIG. 2 that the distillate fractions from distillation column 114 are combined in stream 116, the present inventive subject matter also contemplates a configuration (not shown) in which the various distillate streams are not combined. The individual distillate streams are then fed to individual hydroprocessing units in which the individual distillate streams are hydroprocessed in accordance with the hydroprocessing units described herein.

Figure 3:
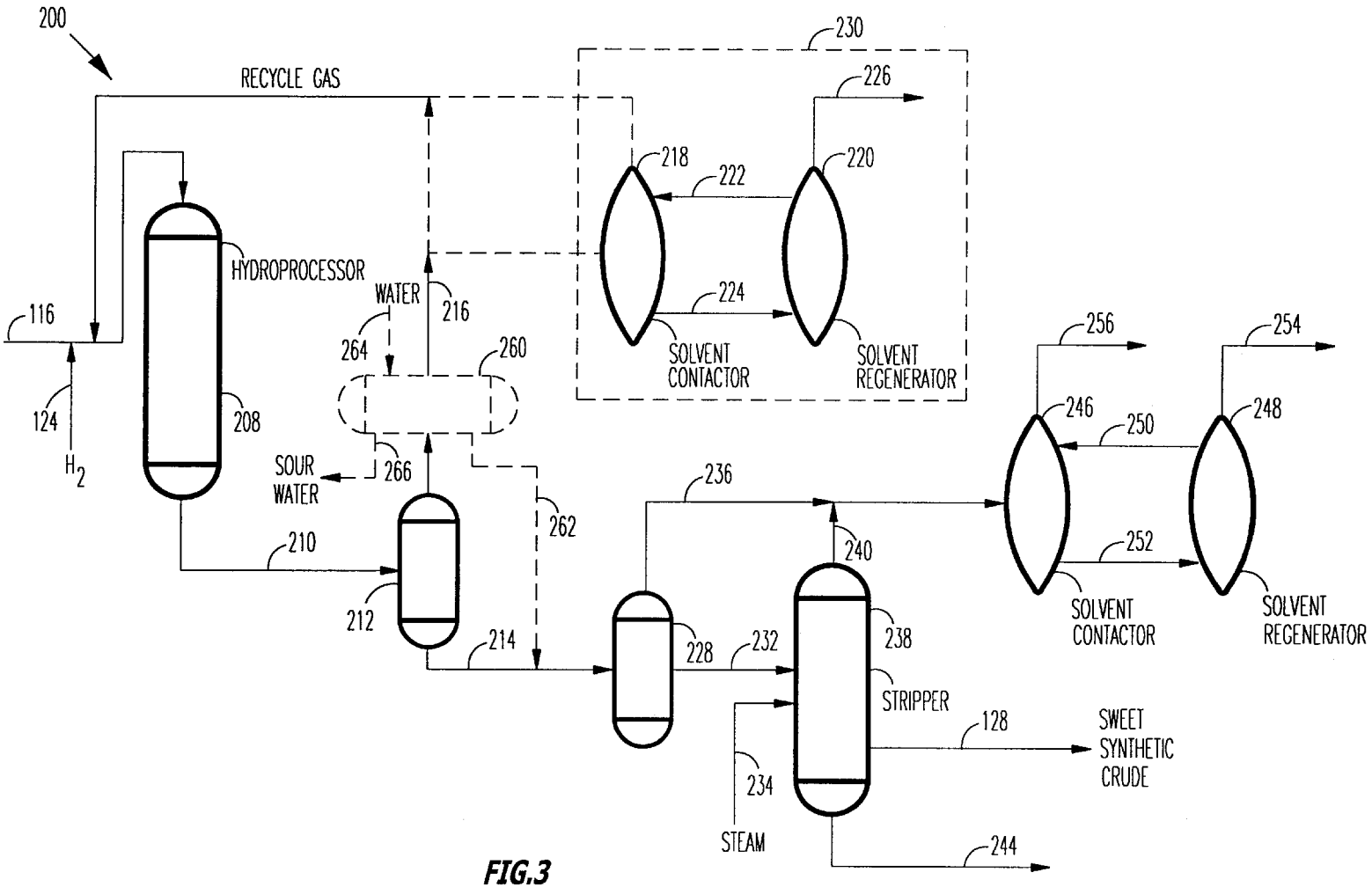
FIG. 3 is a block diagram of a hydroprocessing apparatus useful in the present inventive subject matter.

FIG. 3 represents an example of a hydroprocessing unit which may be employed in the apparatuses of FIGS. 1 and 2 above. Numeral 200 depicts a hydroprocessing unit in which distillate stream 116 is applied to hydroprocessor 208. Hydroprocessor 208 is a reaction vessel in which heat and pressure are added to the distillate fraction, thereby producing a high-pressure hydroprocessed product present in line 210. Hydroprocessor 208 may be run as a hydrotreating unit or as a hydrocracking unit. As is known, a hydrotreating unit is run at less severe temperatures and pressures than a hydrocracking unit, resulting in a hydrotreated product that has a wider boiling point range than a hydrocracked product that has a narrow boiling point range. For example, if hydroprocessor 208 is run as a hydrotreater, the pressure inside the reaction vessel may be on the order of 1000 pounds per square inch (psi). On the other hand, if hydroprocessor 208 is operated as a hydrocracker, the pressure may be as high as 3000 psi.

The high-pressure hydroprocessed product in line 210 is fed to first flash vessel 212 wherein the high-pressure hydroprocessed product is separated into high pressure sour gas and high pressure flashed product. High pressure flash product is fed via line 214 to second flash vessel 228. Second flash vessel 228 separates the high pressure flash product into low pressure sour gas in line 236 and a low pressure flashed product in line 232. Low pressure flashed product in line 232 is fed to stripper 238 along with steam from line 234. Stripper 238 strips impurities from low pressure flashed product using steam, thereby producing low pressure sour gas in line 240 which is combined with low pressure sour gas in line 236, sweet synthetic crude in line 128 and sour water in line 244. Additional intermediate or low pressure flash vessels may be added to improve the recovery of heat or hydrogen in the system.

Low pressure sour gas in lines 236 and 240 (which is combined with line 236) is then fed to a gas sweetening apparatus. In particular, low pressure sour gas in line 236 is fed to solvent contactor 246, a vessel in which the low pressure sour gas is contacted with a solvent. The solvent, which may be a chemical solvent or a physical solvent, is used to remove hydrogen sulfide and other impurities from the low pressure sour gas, thus sweetening the low pressure sour gas. Preferably, the solvent is an amine-based chemical solvent. Solvent contactor 246 is in fluid communication with solvent regenerator 248. Solvent contactor 248 receives lean solvent (solvent that does not contain hydrogen sulfide or other impurities) from solvent regenerator 248 via line 250. The lean solvent is contacted with the low pressure sour gas in solvent contactor 246, whereby the hydrogen sulfide and other impurities are absorbed by the solvent. The rich solvent (containing the hydrogen sulfide and other impurities) is then fed back to solvent regenerator 248 via line 252, where the impurities are removed from the solvent, thereby producing lean, or clean, solvent, and removed from the gas sweetening apparatus via line 254. Clean fuel gas is removed from solvent contactor 246 via line 256.

High pressure sour gas from first flash vessel 212 is removed from the vessel via line 216. The high pressure sour gas may be used as a recycle gas and fed to hydroprocessor 208. Preferably, high pressure sour gas in line 216 is first sweetened using gas sweetening apparatus 230. Gas sweetening apparatus 230 comprises solvent contactor 218 and solvent regenerator 220. High pressure sour gas in line 216 is fed to solvent contactor 218, a vessel in which the high pressure sour gas is contacted with a solvent. The solvent, which may be a chemical solvent or a physical solvent, is used to remove hydrogen sulfide and other impurities from the high pressure sour gas, thus sweetening the high pressure sour gas. Preferably, the solvent is an amine-based chemical solvent. Solvent contactor 218 is in fluid communication with solvent regenerator 220. Solvent contactor 218 receives lean solvent (solvent that does not contain hydrogen sulfide or other impurities) from solvent regenerator 220 via line 222. The lean solvent is contacted with the low pressure sour gas in solvent contactor 218, whereby the hydrogen sulfide and other impurities are absorbed by the solvent. The rich solvent (containing the hydrogen sulfide and other impurities) is then fed back to solvent regenerator 220 via line 224, where the impurities are removed from the solvent, thereby producing lean, or clean, solvent, and the impurities are removed from the gas sweetening apparatus via line 226. Clean gas is removed from solvent contactor and recycled back to hydroprocessor 208.

In a preferred embodiment of the present inventive subject matter, solvent regenerators 248 and 220 are the same piece of apparatus, receiving the rich solvent from and supplying the lean solvent to both solvent contactors 246 and 218.

In a further optional embodiment of the present inventive subject matter, high pressure sour gas in line 216 is fed to third flash vessel 260 along with water from line 264. The water acts to remove ammonia and other impurities from the high pressure sour gas before the high pressure sour gas is fed to hydroprocessor 208 or gas sweetening apparatus 230. Sour water and further high pressure flashed product are produced in flash vessel 260. Sour water exits flash vessel 260 via line 266, while further high pressure flashed product exits flash vessel 260 via line 262 and is combined with high pressure flashed product from flash vessel 212 in line 214.

While the above describes gas sweetening apparatus usable with the hydroprocessing unit, further gas sweetening apparatus as described below with respect to FIG. 5 may also be used.

Figure 4:
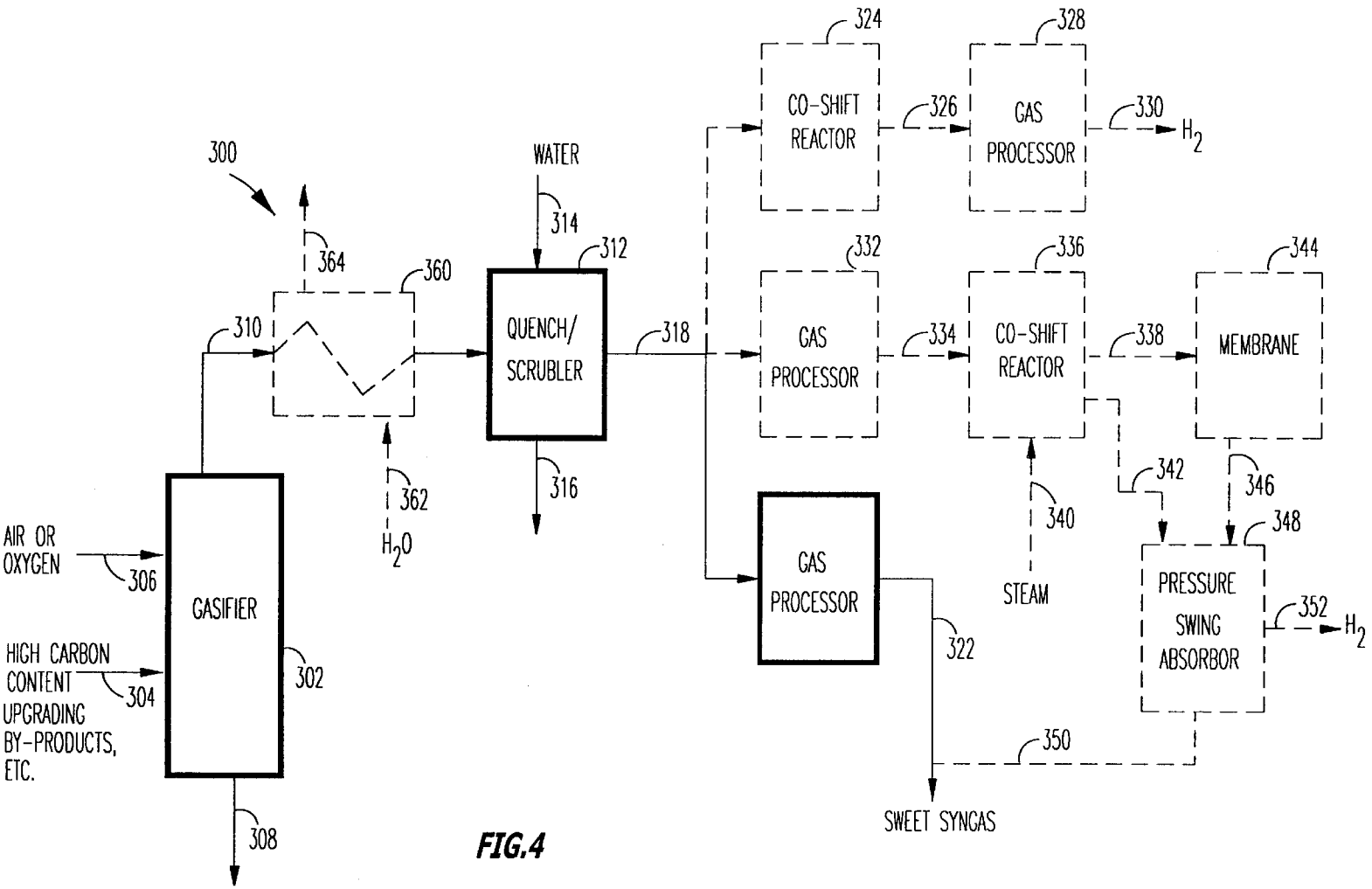
FIG. 4 is a block diagram of a gasifier apparatus useful in the present inventive subject matter.

FIG. 4 depicts an example of a gasifier unit which may be employed in the apparatuses of FIGS. 1 and 2 above. Numeral 300 depicts a gasifying apparatus in which high-carbon content upgrading by-products, including asphaltenes, are applied to gasifier 302. Gasifier 302 is a reaction vessel equipped with a burner to promote a reaction between the high-carbon content upgrading by-products from line 304 with air or oxygen supplied by line 306. The amount of air or oxygen supplied to gasifier 302 is limited so that only a partial oxidation of the high-carbon content by-product occurs. The gasification process in gasifier 302 results in the production of syngas comprising hydrogen, carbon monoxide, carbon dioxide, hydrogen sulfide and small amounts of other compounds. Also produced by gasifier 302 is ash or slag, which is removed from gasifier 302 via line 308.

The syngas exiting gasifier 302 via line 310 is at an elevated temperature. The syngas is fed to quench/scrubber 312, to which water is also added via line 314, wherein the water cools the syngas and removes some of the hydrogen sulfide, ammonia and other impurities in the form of sour water. The sour water is removed from quench/scrubber 312 via line 316. The cooled syngas mixture is then fed to gas processing unit 320 via line 318 wherein the cooled syngas mixture is sweetened by the removal of further hydrogen sulfide and other impurities. Gas processing/sweetening unit 318 may be as described above with respect to FIG. 3, or may take the configuration as described below with respect to FIG. 5. Sweet syngas exits gas processing unit 320 via line 322.

Other optional embodiments are available for the gasifier configuration depicted in FIG. 4. In one optional embodiment, the gas mixture leaving quench/scrubber 312 via line 318 is fed to gas processing unit 332. As is the case with gas processing unit 320, gas processing unit 332 may be as described above with respect to FIG. 3, or may take the configuration as described below with respect to FIG. 5. The product of gas processing unit 332 is transported via line 334 to CO shift reactor 336. CO shift reactor 336 is a well-known piece of apparatus wherein the syngas in line 334 is partially reacted with steam from line 340 to form hydrogen gas and carbon dioxide. The syngas, hydrogen gas and carbon dioxide may then be fed via line 338 to membrane 344 prior to being fed via line 346 to pressure swing absorber 348. Pressure swing absorber 348 separates hydrogen gas from other gases through physical separation. Hydrogen gas exits via line 352, and the remaining sweet syngas is combined with the sweet syngas in line 322 via line 350. Optionally, the syngas, hydrogen gas and carbon dioxide from CO shift reactor 336 may be fed directly to pressure swing absorber 348 via line 342.

In another optional embodiment, the gas mixture leaving quench/scrubber 312 via line 318 is fed to CO shift reactor 324. CO shift reactor 324 is a well-known piece of apparatus wherein the syngas in line 318 is partially reacted with steam (not shown) to form hydrogen gas and carbon dioxide. The syngas, hydrogen gas and carbon dioxide from CO shift reactor 324 is applied via line 326 to gas processing unit 328. As is the case with gas processing units 320 and 332, gas processing unit 328 may be as described above with respect to FIG. 3, or may take the configuration as described below with respect to FIG. 5. Hydrogen gas produced and separated in gas processing unit 328 is removed via line 330, while sweet syngas produced and separated in gas processing unit 328 is removed via line 354.

In a further optional embodiment, the gas syngas in line 310 is applied to once-through steam generator 360 along with water from line 362. Once-through steam generator 360 is an apparatus that accepts low quality water containing a high degree of dissolved solids. Utilizing heat in the syngas in line 310, once-through steam generator 360 partially vaporizes the water from line 362, forming saturated steam and water. The saturated steam and water exit once-through steam generator 360 via line 364. An advantage of using once-through steam generator 360 is that only about 80% of the water from line 362 is vaporized, with the remaining water containing the dissolved solids present in the water. This allows lower quality water to be used in generating saturated steam and keeps the dissolved solids from depositing on the walls of once-through steam generator 360. It is contemplated within the scope of the present inventive subject matter that the saturated steam generated by once-through steam generator be used as a source to meet steam requirements through out the apparatus as described herein.

Figure 5:
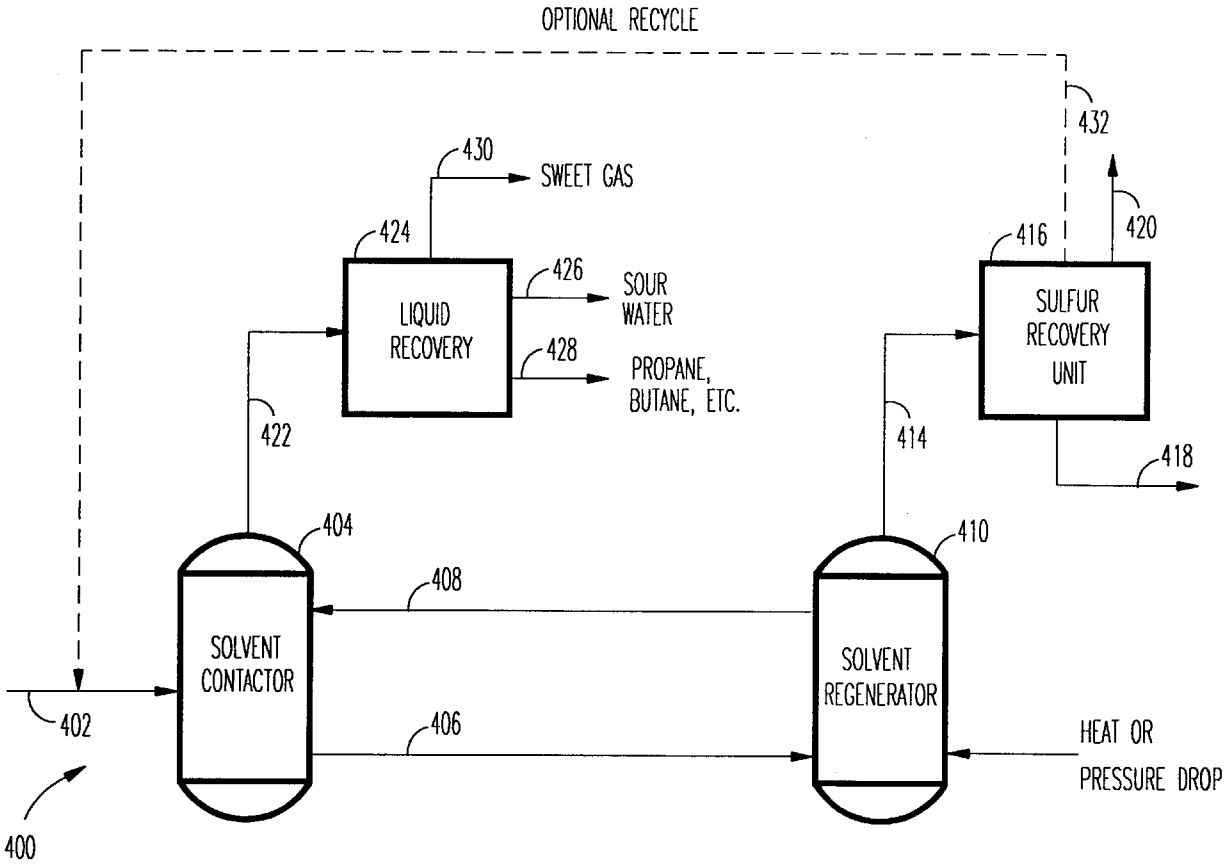
FIG. 5 is a block diagram of a gas processing/sweetening apparatus useful in the present inventive subject matter.

Turning now to FIG. 5, numeral 400 refers to a gas processing/sweetening unit to be used in accordance with the present inventive subject matter. As has been discussed above, the gas processing/sweetening unit described with reference to FIG. 5 is but one possible embodiment of an apparatus useful for removing hydrogen sulfide and other impurities from various gas streams located throughout the apparatus of the present inventive subject matter. In apparatus 400, the sour gas mixture is supplied to solvent contactor 404 via line 402. However, one of ordinary skill in the art will recognize that solvent contactor 404 is equivalent to other solvent contactors already described herein with reference to other figures. For example, solvent contactor 404 is equivalent, and therefore interchangeable with solvent contactor 246 of FIG. 3. Likewise, line 402 which supplies sour gas to solvent contactor 404 is equivalent with line 236 which supplies sour gas to solvent contactor 246 in FIG. 3.

Returning to apparatus 400 in FIG. 5, solvent contactor 404 is a vessel in which the sour gas is contacted with a solvent. The solvent, which may be a chemical solvent or a physical solvent, is used to remove hydrogen sulfide and other impurities from the sour gas, thus sweetening the sour gas. Preferably, the solvent is an amine-based chemical solvent. Solvent contactor 404 is in fluid communication with solvent regenerator 410. Solvent contactor 404 receives lean solvent (solvent that does not contain hydrogen sulfide or other impurities) from solvent regenerator 410 via line 408. The lean solvent is contacted with the sour gas in solvent contactor 404, whereby the hydrogen sulfide, ammonia and other impurities are absorbed by the solvent. The rich solvent (containing the hydrogen sulfide and other impurities) is then fed back to solvent regenerator 410 via line 406, where the impurities are removed from the solvent by the addition of heat or, alternatively, by a pressure drop through the solvent regeneration vessel, thereby producing lean, or clean, solvent. Acid gas containing the hydrogen sulfide and other impurities exit hydrogen regenerator 410 via line 414. The acid gas is applied to sulfur recovery unit 416 in which the sulfur is removed from the acid gas. The sulfur exits sulfur recovery unit 416 via line 418. The de-sulfurized gas is released to the atmosphere via line 420, or may optionally be recycled to solvent contactor 404 via recycle line 432.

Clean product is removed from solvent contactor 404 via line 422. The clean product is fed to liquid recovery unit 424 wherein clean products are further separated. Sweet gas exits liquid recovery unit 424 via line 430, while sweet liquid products such as, for example, liquid propane, liquid butane, etc. exit liquid recovery unit 424 via line 428. Sour water, containing the vast majority of the remaining impurities, exits liquid recovery unit 424 via line 426.

Figure 6:
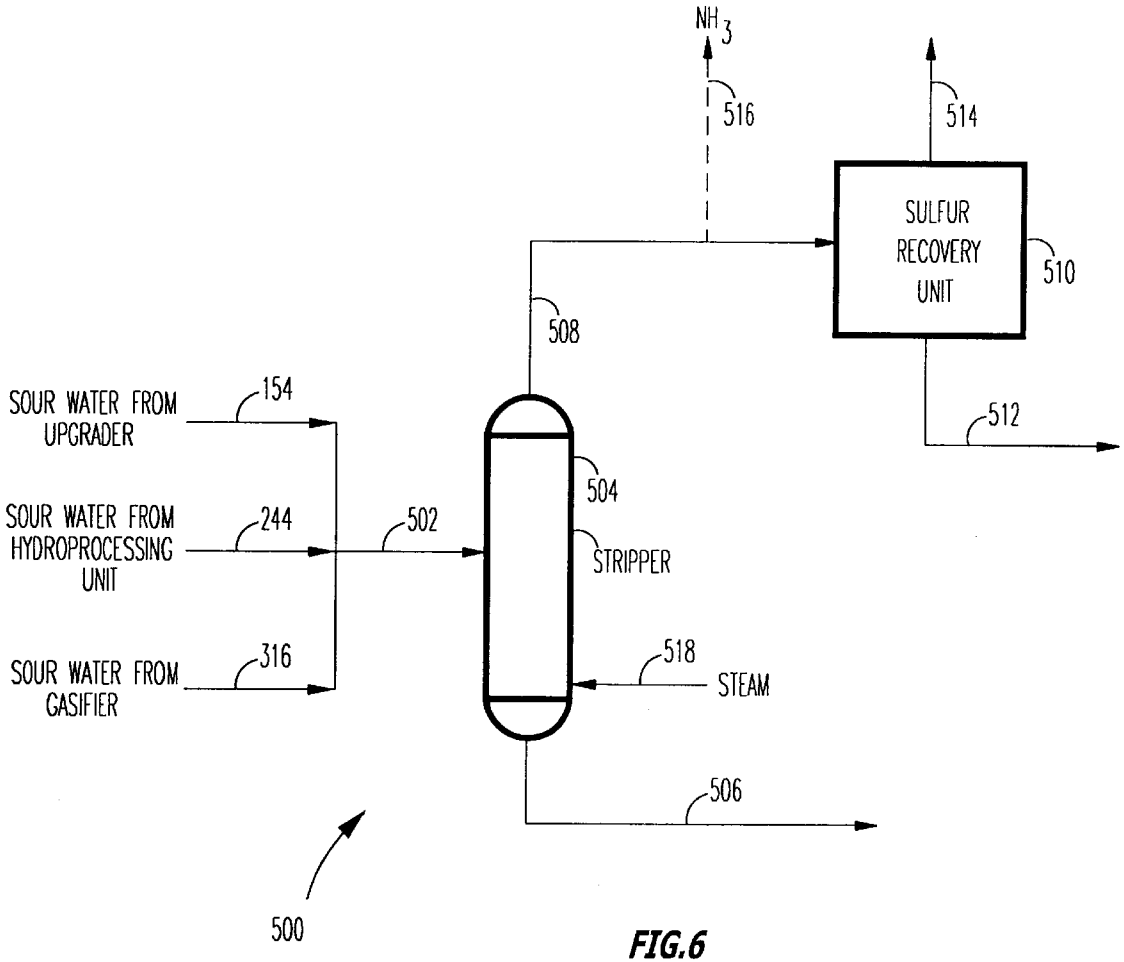
FIG. 6 is a block diagram of a water treatment apparatus useful in the present inventive subject matter.

FIG. 6 illustrates an apparatus for treating the sour water produced by the various components of the present inventive subject matter. As is described above, a number of the components produce sour water as a by-product of the process used with the apparatus. Numeral 500 refers to an apparatus for treating the sour water produced within the various pieces of apparatus found in FIGS. 1–5. In particular, sour water is delivered to stripper 504 from the upgrader apparatus via line 154, from the hydroprocessing unit via line 244 and from the gasifier apparatus via line 316. Optionally, lines 154, 244 and 316 are combined into line 502, which feeds the sour water to stripper 504. However, the present inventive subject matter also contemplates the individual lines being fed directly to stripper 504 (not shown).

Stripper 504 utilizes steam from line 518 to strip the impurities from the water. The stripped water exits stripper 504 via line 506 and may be used throughout the process, or may be injected into the ground. Acid gas containing the hydrogen sulfide, ammonia and other impurities exit the stripper via line 508. The ammonia is optionally separated and removed from the acid gas via line 516. The acid gas is fed to sulfur recovery unit 510 wherein the sulfur is separated from the remaining gases. The sulfur exits sulfur recovery unit 510 via line 512, while the de-sulfurized gas is release as an emission via line 514.

The inventive subject matter being thus described, it will be obvious that the same may be varied in many ways. Such variations are not to be regarded as a departure from the spirit and scope of the inventive subject matter, and all such modifications are intended to be included within the scope of the following claims.

What is claimed is:

1. An apparatus for producing sweet synthetic crude from a heavy hydrocarbon feed comprising:

a) an upgrader for receiving said heavy hydrocarbon feed and producing a distillate fraction including sour products, and high-carbon content by-products;

b) a gasifier for receiving said high-carbon content by-products and producing synthetic fuel gas and sour by-products;

c) a hydroprocessing unit for receiving said sour by-products and hydrogen gas, thereby producing gas and said sweet crude; and d) a hydrogen recovery unit for receiving said synthetic fuel gas and producing further hydrogen gas and hydrogen-depleted synthetic fuel gas, said further hydrogen gas being supplied to said hydroprocessing unit wherein said upgrader comprises:

i) a distillation column for receiving said heavy hydrocarbon feed and producing said distillate fraction, and a non-distilled fraction containing sulfur, asphaltene and metals;

ii) a solvent deasphalting unit for processing said non-distilled fraction and producing a deasphalted oil stream and an asphaltene stream, an outlet of said deasphalting unit containing said deasphalted oil being connected to an inlet of a thermal cracker and wherein said asphaltene stream comprises said high-carbon by-products; and iii) said thermal cracker thermally cracking said deasphalted oil and forming a thermally cracked stream;

and wherein said hydroprocessing unit comprises:

A) a hydroprocessor which receives said distillate fraction and hydrogen gas and produces a high-pressure hydroprocessed product;

B) a first flash vessel which receives said high-pressure hydroprocessed product and produces high pressure sour gas and high pressure flashed product;

C) a second flash vessel which receives said high pressure flashed product and produces low pressure sour gas and low pressure flashed product;

D) a stripper which receives said low pressure flashed product and steam and produces low pressure sour gas, sour water and sweet synthetic crude;

E) a first solvent contactor in fluid communication with a first solvent regenerator and containing a clean solvent, said first solvent contactor receiving said high pressure sour gas from said first flash vessel and producing sweet recycle gas which is fed to said hydroprocessor and sour solvent, said first solvent regenerator receiving said sour solvent and producing said clean solvent which is fed to said first solvent contactor and hydrogen sulfide and ammonia; and F) a second solvent contactor in fluid communication with a second solvent regenerator and containing clean solvent, said second solvent contactor receiving said low pressure sour gas from said second flash vessel and from said stripper and producing fuel gas and sour solvent, said second solvent regenerator receiving said sour solvent and producing said clean solvent which is fed to said second solvent contactor.

2. The apparatus according to claim 1, wherein an outlet of said thermal cracker is connected to an inlet of said distillation column and supplies said thermally cracked stream to said distillation column.

3. The apparatus according to claim 1, wherein a catalyst is present to aid in thermally cracking said deasphalted oil.

4. The apparatus according to claim 1 wherein said first solvent regenerator and said second regenerator are the same piece of apparatus.

5. The apparatus according to claim 1 wherein said gasifier gasifies said high-carbon by-products in the presence of oxygen and produces ash and a gas mixture, said apparatus further comprising:

a) a scrubber which receives said gas mixture and water and produces sour water and a clean sour gas mixture; and b) a first gas processor which receives said clean sour gas mixture and produces a sweet synthetic fuel gas.

6. The apparatus according to claim 5, further comprising:

a) a second gas processor which receives a portion of said clean sour gas mixture and produces a processed gas mixture;

b) a carbon monoxide water/gas shift reactor which receives at least a portion of said processed gas mixture and produces a hydrogen-enriched gas mixture; and c) a system for producing hydrogen-enriched gas mixture from a synthetic fuel gas.

7. The apparatus according to claim 6 wherein said system comprises a pressure swing absorber.

8. The apparatus according to claim 6 wherein said system comprises a membrane.

9. The apparatus according to claim 6 wherein said system comprises a cryogenic separator.

10. The apparatus according to claim 6, wherein said first and said second gas processors each comprise:

a) a solvent contactor which receives lean solvent from a solvent regenerator and said clean sour gas mixture and produces a sweet product and rich solvent;

b) said solvent regenerator receiving said rich solvent and producing said lean solvent and acid gas; and c) a sulfur recovery unit which receives said acid gas and produces sulfur and a sulfur-depleted gas which is vented to the atmosphere.

11. The apparatus according to claim 5, further comprising:

a) a second gas processor which receives a portion of said clean sour gas mixture and produces a processed gas mixture; and b) a system for producing hydrogen-enriched gas mixture from a synthetic fuel gas.

12. The apparatus according to claim 11 wherein said system comprises a pressure swing absorber.

13. The apparatus according to claim 11 wherein said system comprises a membrane.

14. The apparatus according to claim 11 wherein said system comprises a cryogenic separator.

15. The apparatus according to claim 5, wherein first gas processor comprises:

a) a solvent contactor which receives lean solvent from a solvent regenerator and said clean sour gas mixture and produces a sweet product and rich solvent;

b) said solvent regenerator receiving said rich solvent and producing said lean solvent and acid gas;

c) a sulfur recovery unit which receives said acid gas and produces sulfur and a sulfur-depleted gas which is vented to the atmosphere; and d) a liquid recovery unit which receives said sweet product and produces sweet gas, sour water and light liquid hydrocarbons.

16. The apparatus according to claim 1, further comprising a first gas processor which receives sour gas from said distillation column, said first gas processor comprising:

a) a solvent contactor which receives lean solvent from a solvent regenerator and said sour gas and produces a sweet product and rich solvent;

b) said solvent regenerator receiving said rich solvent and producing said lean solvent and acid gas;

c) a sulfur recovery unit which receives said acid gas and produces sulfur and a sulfur-depleted gas which is vented to the atmosphere; and d) a liquid recovery unit which receives said sweet product and produces sweet gas, sour water and light liquid hydrocarbons.

17. The apparatus according to claim 16, further comprising a second gas processor which receives further sour gas from said hydroprocessing unit, said second gas processor comprising:

a) a further solvent contactor which receives further lean solvent from a further solvent regenerator and said further sour gas and produces a further sweet product and further rich solvent;

b) said further solvent regenerator receiving said further rich solvent and producing said further lean solvent and a further acid gas;

c) a further sulfur recovery unit which receives said further acid gas and produces further sulfur and a further sulfur-depleted gas which is vented to the atmosphere; and d) a further liquid recovery unit which receives said further sweet product and produces further sweet gas, sour water and light liquid hydrocarbons.

18. The apparatus according to claim 1, further comprising a water treatment apparatus which receives sour water from said upgrader, said hydroprocessing unit and said gasifier, said water treatment apparatus comprising a stripper which receives said sour water and steam and produces stripped water, hydrogen sulfide and ammonia.

19. The apparatus according to claim 1, further comprising a hydrogen recovery unit for receiving said synthetic fuel gas and producing hydrogen gas and hydrogen-depleted synthetic fuel gas, said hydrogen gas being supplied to said hydroprocessing unit.

20. An apparatus for producing sweet synthetic crude from a heavy hydrocarbon feed comprising:

a) an upgrader comprising:

I. a distillation column for receiving said heavy hydrocarbon feed and producing a distillate fraction, and a non-distilled fraction containing sulfur, asphaltene and metals;

II a solvent deasphalting unit for processing said non-distilled fraction and producing a deasphalted oil stream and an asphaltene stream, an outlet of said deasphalting unit containing said deasphalted oil being connected to an inlet of a thermal cracker and wherein said asphaltene stream comprises said high-carbon by-products;

III said thermal cracker thermally cracking said deasphalted oil and forming a thermally cracked stream;

b) a gasifier for gasifying said asphaltenes in the presence of air or oxygen and producing ash and a gas mixture;

c) a scrubber which receives said gas mixture and water and produces sour water and a clean sour gas mixture;

d) a first gas processor which receives said clean sour gas mixture and produces a sweet synthetic fuel gas, said first gas processor comprises:

I a solvent contactor which receives lean solvent from a solvent regenerator and said clean sour gas mixture and produces a sweet product and rich solvent;

II said solvent regenerator receiving said rich solvent and producing said lean solvent and acid gas;

III a sulfur recovery unit which receives said acid gas and produces sulfur and a sulfur-depleted gas which is vented to the atmosphere; and IV a liquid recovery unit which receives said sweet product and produces sweet gas, sour water and light liquid hydrocarbons;

e) a hydroprocessing unit for receiving said sour by-products and hydrogen gas, thereby producing gas and said sweet crude, said hydroprocessing unit comprising:

I a hydroprocessor which receives said distillate fraction and hydrogen gas and produces a high-pressure hydroprocessed product;

II a first flash vessel which receives said high-pressure hydroprocessed product and produces high pressure sour gas and high pressure flashed product;

III a second flash vessel which receives said high pressure flashed product and produces low pressure sour gas and low pressure flashed product;

IV a stripper which receives said low pressure flashed product and steam and produces low pressure sour gas, sour water and sweet synthetic crude;

V a first solvent contactor in fluid communication with a first solvent regenerator and containing a clean solvent, said first solvent contactor receiving said high pressure sour gas from said first flash vessel and producing sweet recycle gas which is fed to said hydroprocessor and sour solvent, said first solvent regenerator receiving said sour solvent and producing said clean solvent which is fed to said first solvent contactor and hydrogen sulfide and ammonia; and VI a second solvent contactor in fluid communication with a second solvent regenerator and containing clean solvent, said second solvent contactor receiving said low pressure sour gas from said second flash vessel and from said stripper and producing fuel gas and sour solvent, said second solvent regenerator receiving said sour solvent and producing said clean solvent which is fed to said second solvent contactor; and f) a hydrogen recovery unit for receiving said synthetic fuel gas and producing further hydrogen gas and hydrogen-depleted synthetic fuel gas, said further hydrogen gas being supplied to said hydroprocessing unit.

21. A method for producing sweet synthetic crude from a heavy hydrocarbon feed comprising:

a) upgrading said heavy hydrocarbon feed in an upgrader and thereby producing a distillate feed including sour products, and high-carbon content by-products;

b) gasifying in a gasifier said high-carbon content by-products and producing synthetic fuel gas and sour by-products;

c) hydroprocessing said sour products along with hydrogen gas, thereby producing gas and said sweet crude; and d) recovering hydrogen in a hydrogen recovery unit from said synthetic fuel gas and producing further hydrogen gas and hydrogen-depleted synthetic fuel gas, and supplying said further hydrogen gas to said hydroprocessing unit wherein said upgrading step further comprises the steps of:

i) distilling in a distillation column said heavy hydrocarbon feed and producing a distillate fraction, and a non-distilled fraction containing sulfur, asphaltene and metals;

ii) solvent deasphalting in a solvent deasphalting unit said non-distilled fraction and producing a deasphalted oil stream and an asphaltene stream, supplying said deasphalted oil being connected to an inlet of a thermal cracker and wherein said asphaltene stream comprises said high-carbon by-products;

iii) thermally cracking said deasphalted oil and forming a thermally cracked stream; and wherein said hydroprocessing steps further comprise the steps of:

A) hydroprocessing said distillate feed along with hydrogen gas and produces a high-pressure hydroprocessed product;

B) flashing in a first flash vessel said high-pressure hydroprocessed product thereby producing high pressure sour gas and high pressure flashed product;

C) flashing in a second flash vessel said high pressure flashed product and producing low pressure sour gas and low pressure flashed product;

D) stripping in a stripper said low pressure flashed product along with steam and producing low pressure sour gas, sour water and sweet synthetic crude;

E) contacting said high pressure sour gas with a clean solvent in a first solvent contactor which is in fluid communication with a first solvent regenerator, thereby producing sweet recycle gas which is fed to said hydroprocessor and sour solvent, regenerating said sour solvent in said solvent regenerator thereby producing said clean solvent, and feeding said clean solvent to said first solvent contactor; and F) contacting said low pressure sour gas from said second flash vessel and said stripper with a second clean solvent in a second solvent contactor which is in fluid communication with a second solvent regenerator thereby producing fuel gas and sour solvent, regenerating sour solvent in said second solvent regenerator thereby producing said second clean solvent and feeding said second clean solvent to said second solvent contactor.

22. The method according to claim 21 wherein said first solvent regenerator and said second regenerator are the same piece of apparatus.

23. The method according to claim 21 wherein said gasifying step is conducted in the presence of air or oxygen and produces ash and a gas mixture, said method further comprising the steps of:

a) scrubbing said gas mixture along with water thereby producing sour water and a clean sour gas mixture; and b) processing said clean sour gas mixture in a first gas processor thereby producing a sweet synthetic fuel gas.

24. The method according to claim 23, wherein said processing step further comprises the steps of:

a) a solvent contactor which receives lean solvent from a solvent regenerator and said clean sour gas mixture and produces a sweet product and rich solvent;

b) said solvent regenerator receiving said rich solvent and producing said lean solvent and acid gas;

c) a sulfur recovery unit which receives said acid gas and produces sulfur and a sulfur-depleted gas which is vented to the atmosphere; and d) a liquid recovery unit which receives said sweet product and produces sweet gas, sour water and light liquid hydrocarbons.

25. The method according to claim 21, further comprising a first step of processing sour gas from said distillation column in a first gas processor, said first processing step comprising:

a) contacting said sour gas with lean solvent in a solvent contactor thereby producing a sweet product and rich solvent;

b) regenerating said lean solvent in a solvent regenerator to which is fed said rich solvent, thereby also producing acid gas, and supplying said lean solvent to said solvent contactor;

c) recovering sulfur from said acid gas in a sulfur recovery unit thereby producing a sulfur-depleted gas which is vented to the atmosphere; and d) producing sweet gas, sour water and light liquid hydrocarbons in a liquid recovery unit which receives said sweet product.

26. The method according to claim 25, further comprising a second step of processing further sour gas from said hydroprocessing unit in a second gas processor, said second processing step comprising:

a) contacting said further sour gas with a further lean solvent in a further solvent contactor thereby producing a further sweet product and further rich solvent;

b) regenerating said further lean solvent in a further solvent regenerator to which is fed said further rich solvent, thereby also producing further acid gas, and supplying said further lean solvent to said further solvent contactor;

c) further recovering sulfur from said further acid gas in a further sulfur recovery unit thereby producing a further sulfur-depleted gas which is vented to the atmosphere; and d) and further producing sweet gas, sour water and light liquid hydrocarbons in a further liquid recovery unit which receives said further sweet product.

27. The method according to claim 21, further comprising the step of treating sour water from said upgrader, said hydroprocessing unit and said gasifier, said water treatment step comprising stripping said sour water in a stripper along with steam thereby producing stripped water, hydrogen sulfide and ammonia.

28. The method according to claim 21, further comprising the step of recovering hydrogen from said synthetic fuel gas in a hydrogen recovery unit and feeding said hydrogen gas to said hydroprocessing unit.

* * * * *